US006073100A

United States Patent [19]

Goodridge, Jr.

[11] Patent Number: 6,073,100

[45] Date of Patent: Jun. 6, 2000

[54] METHOD AND APPARATUS FOR SYNTHESIZING SIGNALS USING TRANSFORM-DOMAIN MATCH-OUTPUT EXTENSION

[76] Inventor: Alan G Goodridge, Jr., 111 N. Rengstorff Ave. #91, Mountain View, Calif. 94043

[21] Appl. No.: 08/828,592

[22] Filed: Mar. 31, 1997

[51] Int. Cl.[7] ..... G10L 9/00

[52] U.S. Cl. ..... 704/258; 704/207

[58] Field of Search ..... 704/243, 258, 704/207, 208, 219, 265, 203, 205, 200, 201, 268, 500

[56] References Cited

U.S. PATENT DOCUMENTS

| | | | |
|---|---|---|---|
| 4,464,784 | 8/1984 | Agnello | 381/61 |
| 4,885,790 | 12/1989 | McAvlay et al. | 381/36 |
| 4,991,213 | 2/1991 | Wiilson | 704/207 |
| 5,012,517 | 4/1991 | Wilson et al. | 704/207 |
| 5,175,769 | 12/1992 | Hejna, Jr. et al. | 704/211 |
| 5,504,833 | 4/1996 | George et al. | 395/2.2 |

OTHER PUBLICATIONS

D. W. Griffin and J. S. Lim, "Signal Estimation from Modified Short–Time Fourier Transform," IEEE Transactions on Acoustics, Speech, and Signal Processing, Apr. 1984, vol. ASSP–32, No. 2, pp 236–243.

J. L. Flanagan and R. M. Golden, "Phase Vocoder," Bell System Technical Journal, Nov. 1996, vol. 45, pp 1493–1509.

D. W. Griffin and J. S. Lim, "A New Model–Based Speech Analysis/Synthesis System," proceedings of the IEEE International Conference on Acoustics, Speech and Signal Processing, Mar. 1985, vol. 2, pp 513–516.

R. E. Crochiere, "A Weighted Overlap–Add Method of Short–Time Fourier Analysis/Synthesis," IEEE Transactions on Acoustics, Speech, and Signal Processing, Feb. 1980, vol. ASSP–28, No. 1, pp 99–102.

J. Makhoul, "Linear Prediction: A Tutorial Review," Proceedings of the IEEE, Apr. 1975, vol. 63, pp 561–580.

S. Seneff, "System to Independently Modify Excitation and/or Spectrum of Speech Waveform Without Explicit Pitch Extraction," IEEE Transactions on Acoustics, Speech, and Signal Processing, Aug. 1982, vol. ASSP–30, No. 4, pp 566–578.

(List continued on next page.)

*Primary Examiner*—Richemond Dorvil

[57] ABSTRACT

A method of synthesizing audio signals provides outputs of high subjective quality which retain the semblance of natural origin. Unlike frequency scaling methods, the pitch of a signal can be modified independently of the spectrum envelope. A set of candidate input sections is defined based on input transform-domain signal representations. A match-output transform-domain section is formed using the result of a matching process which compares candidate input sections to a reference section. The reference section for this matching process is defined based on one or more previously formed match-output sections. Main-output transformdomain signal representations are formed based on one or more match-output sections, whereby such main-output transform-domain signal representations can be inverse-transformed and combined with the output time-domain signal. This method is referred to as "Transform-Domain Match-Output Extension" (TDMOX). One embodiment of the invention implements block-transform processing using an FFT algorithm. Matching processes search over ranges of frequency shifts, ranges of time shifts, and ranges of resampling factors. Selections are based on maximum cross-correlation, maximum sum of dot products, and minimum sum of squared differences, respectively. Applications include text-to-speech synthesis, audio editing, musical effects processing, real-time low-delay voice transformation, internet telephony, voice mail, Karaoke, hearing aids, and film animation.

61 Claims, 9 Drawing Sheets -

OTHER PUBLICATIONS

M. Abe, S. Tamura, and H. Kuwabara, "A New Speech Modification Method By Signal Reconstruction," proceedings of the IEEE International Conference on Acoustics, Speech, and Signal Processing, Apr. 1989, pp 592–595.

T. E. Quatieri and R. J. McAulay, "Speech Transformations Based on a Sinusoidal Representation," proceedings of the IEEE International Conference on Acoustics, Speech, and Signal Processing, Mar. 1985, vol. 2, pp 489–492.

T. E. Quatieri and R. J. McAulay, "Speech Transformations Based on a Sinusoidal Representation," IEEE Transactions on Acoustics, Speech, and Signal Processing, Dec. 1986, vol. ASSP–34, No. 6, pp 1449–1461.

W. H. Press, S. A. Teukolsky, W. T. Vetterling, and B. P. Flannery, "Numerical Recipes in C, Second Edition," Cambridge University Press, 1992.

L. R. Rabiner and R. W. Schafer, "Digital Processing of Speech Signals," Prentice–Hall, 1978. Chapter 6.

M. Vetterli and J. Kovacevic, "Wavelets and Subband Coding," Prentice–Hall, 1995. Chapter 3.

W. B. Kleijn and K. K. Paliwal (Editors), "Speech Coding and Synthesis," Elsevier, 1995. Chapter 15: E. Moulines, W. Verhelst, "Time–Domain and Frequency–Domain Techniques for Prosodic Modification of Speech."

METHOD AND APPARATUS FOR SYNTHESIZING SIGNALS USING TRANSFORM-DOMAIN MATCH-OUTPUT EXTENSION

FIELD OF THE INVENTION

The field of the present invention is acoustic and speech signal processing in general, and more particularly the fields of speech signal synthesis and pitch modification. The present invention relates to methods and apparatus for producing high-quality modified signals which retain the semblance of natural origin.

MICROFICHE APPENDIX

This application includes a microfiche appendix.

BACKGROUND OF THE INVENTION

A need has long been recognized for a method which can take normal speech signals as input, and produce high-quality pitch-modified speech signals as output. Such a system could be used by the author of a screenplay, soundtrack, or other type of script to convey stress and intonational patterns that cannot easily be conveyed by text, and to highlight distinctions between interacting voices that make a script more easily understood. Other related uses include localized editing of pitch contours in motion picture dialog, voice quality control in foreign language dubbing, cartoon characters' speech, books on tape, and voice mail over the internet.

In other applications it is necessary to play back recordings with a variety of intonational characteristics, without unduly inflating the storage requirements of a system. A computer game that contains recordings of animated characters, for example, must be distributed over network connections of limited bandwidth or on media of limited capacity. Whether or not an audio recording has been compressed, providing separate storage for modified copies of an original is inefficient. Other examples include systems for hearing evaluation, public address, voice response over a telephone network, and dictation playback.

Pitch modification is particularly useful in the area of text-to-speech synthesis, or simply constrained-vocabulary speech synthesis. Since parametric speech synthesizers often produce a robotic, monotonous cadence that is difficult for many listeners to follow, there is a need in the art for alternative methods of controlling the intonational characteristics of synthesized speech. A system such as an information retrieval engine or automotive navigational aid can produce a more natural-sounding output, by mapping the pitch and timing characteristics of concatenated recordings onto suprasegmental contours derived from the text.

In still other applications, low-delay systems for voice signal modification permit real-time interaction with an audience. Examples of this include Karaoke or other live musical performances, comedic acts, adjustments to the voices of television and radio announcers, and the disguising of protected witnesses' voices in courtroom proceedings or television interviews. Examples of one-to-one interaction include standardized voter polling and public opinion surveys, concealment of identity by law enforcement personnel, hearing aids, and restoration of helium speech.

In all of these applications, the most important factor for commercial acceptance is the subjective quality of the output signal. Previously developed techniques have produced a wide range of objectionable subjective qualities:

reverberation, squeaking sounds, noiselike effects such as buzz and hiss, clicking sounds, hoarseness, irregularities in pitch, etc. Solutions which appear to work well in the music industry succeed because of the nature of musical signals. Musical signals tend to be highly periodic, high in amplitude compared to background aperiodic components, and sustained over relatively long periods of time. In addition, the fundamental frequencies of singing voices are often well into the range of the first two formants. By contrast, normal speech signals have strong unvoiced components, higher rates of articulation, and relatively low pitch. Thus, there is a need in the art for a method of high-quality signal modification that works on normal speech inputs Previous methods for signal modification can be classified into three categories: 1) time-domain methods, 2) transform-domain methods which do not use matching processes, and 3) parametric or model-based methods.

Time-domain methods for "pitch shifting" generally perform the operation of frequency scaling, which does not correspond to the action of a person modulating his or her pitch frequency. To a first approximation, the short-time spectrum of a voice signal is the product of two components: the spectrum envelope, which is a smoothly varying outline of the various peaks and valleys in the spectrum, and the source spectrum, which contains finer-scale detail. FIG. 1 A represents the log magnitude of a short-time spectrum and its corresponding log magnitude envelope. In theory, the fine spectral features correspond to an acoustic excitation, ie vibrating vocal chords or air passing turbulently through a constriction of the vocal tract, while the spectrum envelope corresponds to the acoustic filtering action of the vocal tract. FIG. 1A represents the spectrum of an approximately periodic region of the speech wave, where the excitation is voiced.

A frequency scaling operation scales the entire spectrum in frequency, including the spectrum envelope. In contrast, the action of a person modulating his or her pitch frequency scales the spectrum envelope by only a small amount, due to minor changes in vocal tract length. For a speech signal, the term "pitch shifting" implies that the spectrum envelope remains approximately in place, while the characteristic size of fine spectral features is either increased or decreased. Frequency scaling does not hold the envelope in place, which results in the familiar "Mickey Mouse" or "Alvin the Chipmunk" effect. Nevertheless, some frequency scaling methods are able to produce remarkably noise-free outputs.

This success in producing noise-free outputs is due to the use of matching processes. In general, a time-domain matching process is a computation which measures the degree of similarity or dissimilarity between a reference time-domain segment and a set of candidate time-domain segments. A common example is the cross-correlation function, which can be defined as $$C_n[i] = \sum_m x[n-i+m] \quad w_1[m] \quad y[n+m]w_2[m] \tag{1}$$
$$= \sum_m c_i[m]r[m],$$

where $r[m]=y[n+m]\ w_2\ [m]$ is the reference segment, and $c_i[m]=x[n-i+m]\ w_1[m]$ is the ith candidate segment. $w_2[m]$ is a windowing function that selects a region of the signal $y[n]$ in the vicinity of time index n, and $w_1[m]$ is a windowing function that selects a region of the signal $x[n]$ in the vicinity of time index n−i.

The reference segment is sometimes obtained from the same signal as the candidate segments, in which case a cross-correlation function can be defined as $$C_n[i] = \sum_m x[n-i+m] \quad w_1[m] \quad x[n+m]w_2[m] \tag{2}$$
$$= \sum_m c_i[m]r[m],$$

where $r[m]=x[n+m]\ w_2[m]$ is the reference segment, and $c_i[m]$ is the ith candidate segment as before. The means of x[n] and y[n], or alternatively the means of $c_i[m]$ and r[m], are sometimes removed prior to the computation of $C_n[i]$. A normalized cross-correlation can be obtained by dividing $C_n[i]$ by the square root of the energy product $E_rE_{ci}$, where $$E_r = \sum_m r^2[m] \tag{3a}$$

and $$E_{ci} = \sum_m c_i^2[m]. \tag{3b}$$

FIG. 3 A represents two windowing functions being applied to a time-domain input signal x[n]. FIG. 3B represents the corresponding candidate segment $c_i[m]$, and FIG. 3C represents the corresponding reference segment r[m]. Here, the windowing functions are symmetric and finite-duration. Agnello, U.S. Pat. No. 4,464,784 describes a signal modification method in which reference and candidate segments are obtained from the same signal.

FIG. 3D represents a windowing function being applied to a time-domain output signal y[n].

FIG. 3F represents the corresponding reference segment r[m], while FIG. 3E remains the same as FIG. 3B. Hejna et al., U.S. Pat. No. 5,175,769 describes a time-scale modification method in which the reference segment is obtained from a partially constructed output signal (methods for time-scale modification and frequency scaling can be interconverted by interpolation).

The second major category of previous methods contains transform-domain methods which do not use matching processes. A transform-domain representation of a signal can be obtained in a variety of ways. For audio signals, a commonly used method is the Short-Time Fourier Transform (STFT), which can be defined (from Rabiner and Schafer, "Digital Processing of Speech Signals," which is incorporated by reference) as $$X(n, \Omega) = \sum_m w[n-m] \ x[m]e^{-j\Omega m}, \tag{4}$$

where x[n] is a time-domain input signal, w[n] is a windowing function such as a Hanning window, $e^{-j\Omega m}=\cos(\Omega m)-j\sin(\Omega m)$ is a complex exponential basis function of frequency Ω, and X(n,Ω) is the transform-domain representation. If n is considered fixed and Ω is considered variable, X(n,Ω) is the normal Fourier transform of the sequence w[n−m] x[m], and this is known as the "block transform" method. If Ω is considered variable and n is considered fixed, X(n,Ω) is the convolution of w[n] with $x[n]\ e^{-j\Omega n}$, and this is known as the "filter bank" method. Both methods sample the same function, X(n,Ω), and both provide transform-domain representations. In the absence of signal modifications, and given sufficiently high sampling rates in n and Ω, both representations give back the original signal after inverse-transformation.

One problem with STFR representations, particularly in audio coding applications, is that they are not critically sampled: the total number of transform-domain samples needed for exact reconstruction is greater than the number of time-domain samples being represented. This had led to a variety of alternative transform-domain representations, including polyphase-structured filter banks, modulated filter banks, and tree-structured subband representations such as wavelets (Vetterli and Kovacevic, "Wavelets and Subband Coding," which is incorporated by reference). All of these representations can also be oversampled.

A transform-domain matching process is similar to a time-domain matching process, except that it measures the degree of similarity or dissimilarity between a reference transform-domain section and a set of candidate transform-domain sections. If X[n,k] is an STFT sampled at frequencies Ω=2πk/N, k=0 . . . N−1, a matching function that is useful in block transform methods is $$C_{n,k}[i] = \sum_j (X[n, k-i+j] \ w_1[j]) \quad \text{dot} \quad (Y[n, k+j] \ w_2[j]) \tag{5}$$
$$= \sum_j c_j[j] \text{ dot } r[j],$$

where r[b] is the reference section, $c_j[j]$ is the ith candidate section, and "dot" signifies the dot product between two complex values. $w_2[b]$ is a windowing function that selects a region of Y[n,k] in the vicinity of frequency index k, and $w_1[j]$ is a windowing function that selects a region of X[n,k] in the vicinity of frequency index k−i. In this case, $C_{n,k}[i]$ compares a reference section to candidate sections of variable center frequency index k−i, at fixed time index n. FIG. 4A shows the region of X[n,k] that is used in forming candidate sections $c_i[j]$. Each circle in the figure represents a sample of X[n,k], and circles with a line through them are used in forming one or more candidate sections. Open circles represent the centers [n,k−i]. Each of the open circles corresponds to a sum of dot products according to Eq. (5), and to one particular value of i. Another matching function that is useful in block transform methods is $$C_{n,k}[i] = \sum_j (w^{-(k+j)(n-i)}x[n-i, k+j] \ w_1[j]) \quad \text{dot} \quad (Y[n, k+j] \ w_2[j]) \tag{6}$$
$$= \sum_j c_j[j] \text{ dot } r[j],$$

where $W=e^{-J2\pi/N}$, $c_i[j]$ is the ith candidate section, and $w_1[i]$ is a windowing function that selects a region of X[n,k] in the vicinity of time index n−i. As is well known in the art, a modulation by $W^{-kn}$ converts X[n,k], the fixed-time-reference quantity, into a sliding-time-reference quantity. In this case, $C_{n,k}[i]$ compares a reference section to candidate sections of variable time index n−i, at fixed center frequency k. FIG. 4B shows the region of X[n,k] that is used in forming candidate sections $c_i[j]$. Open circles represent the centers [n−i,k]. Each of the open circles corresponds to a sum of dot products according to Eq. (6), and to one particular value of i. A matching function that is useful in filter bank methods is $$C_{n,k}[i] = \sum_m (w^{-k(n-i)}x[n-i+m, k] \ w_1[m]) \quad \text{dot} \quad (Y[n+m, k] \ w_2[m]) \tag{7}$$

-continued $$= \sum_m c_i[m] \text{ dot } r[m],$$

where $w_2[m]$ is a windowing function that selects a region of Y[n,k] in the vicinity of time index n, and $w_1[m]$ is a windowing function that selects a region of X[n,k] in the vicinity of time index n−i. In this case, $C_{n,k}[i]$ compares a reference section to candidate sections of variable center time index n−i, at fixed frequency k. FIG. 4C shows the region of X[n,k] that is used in forming candidate sections $c_i[m]$. Open circles represent the centers [n−i,k].

Each of the open circles corresponds to a sum of dot products according to Eq. (7), and to one particular value of i. Another matching function that is useful in filter bank methods is $$C_{n,k}[i] = \sum_m (X[n+m, k-i]\ w_1[m]) \text{ dot } (Y[n+m, k]\ w_2[m]) \quad (8)$$

$$= \sum_m c_i[m] \text{ dot } r[m],$$

where $c_i[m]$ is the ith candidate section, and $w_1$, [m] is a windowing function that selects a region of X[n,k] in the vicinity of frequency index k−i. In this case, $C_{n,k}[i]$ compares a reference section to candidate sections of variable frequency k−i, at fixed center time index n. FIG. 4D shows the region of X[n,k] that is used in forming candidate sections $c_i[m]$. Open circles represent the centers [n,k-i]. Each of the open circles corresponds to a sum of dot products according to Eq. (8), and to one particular value of i.

As with time-domain matching processes, other measures of similarity or dissimilarity are possible. One measure that has been used in some methods is a cross-correlation between magnitude spectra or power spectra. If X[n,k] and Y[n,k] represent transform-domain magnitudes, such a measure can be obtained from any of the above forms by removing any unit-magnitude modulations and replacing the dot product with scalar multiplication. In the case of positive-valued functions like magnitude and power spectra, another possibility is to take logarithms, remove the mean logarithm, and then use an absolute magnitude difference function (AMDF) or cross-correlation.

Several transform-domain methods which do not use matching processes have been described in the literature. In an article entitled "Phase Vocoder", J. L. Flanagan and R. M. Golden describe a method of constructing time-domain output from frequency-scaled phase derivative signals. This method causes phase relationships between different bands to be arbitrarily altered, and produces a characteristic type of reverberation. In an article entitled "System to Independently Modify Excitation and/or Spectrum of Speech Waveform Without Explicit Pitch Extraction," S. Seneff describes a method which divides out a spectrum envelope in the frequency domain, and then restores this envelope after frequency-scaling the excitation spectrum using phase vocoder methods. In an article entitled "A New Speech Modification Method By Signal Reconstruction," M. Abe et al use the iterative procedure of D. W. Griffin and J. S. Lim to approximate a magnitude spectrum condition obtained through homomorphic analysis. None of these methods utilize matching processes.

The third major category of previous methods is parametric or model-based methods. A typical modelbased approach is to deconvolve a signal using a model filter, such as the model filter defined by a set of Linear Prediction coefficients, frequency-scale the resulting source signal, and then form a time-domain output by passing the frequency-scaled source signal through the model filter. This approach produces many objectionable subjective qualities.

Another parametric method is described by D. W. Griffin and J. S. Lim in an article, "A New Model-Based Speech Analysis/Synthesis System". In this method, the pitch and spectrum envelope for each frame are determined by a matching process which compares model magnitude spectra to the observed magnitude spectrum. Another parametric method which uses a matching process is described by T. E. Quatieri and R. J. KMcAulay in an article entitled "Speech Transformations Based on a Sinusoidal Representation", and in U.S. Pat. No. 4,885,790. In this method, input signals are approximated by a set of sinusoids having time-varying amplitudes, frequencies, and phases. For each input frame, the frequencies of the model sinusoids are determined by peak-peaking methods. Such peaks are then connected from frame to frame using a matching process which incorporates a birth-death algorithm. In order to produce an output signal which approximates an unmodified input, the amplitudes, frequencies, and phases of the model sinusoids are interpolated from frame to frame. Pitch scaling and frequency scaling are provided by scaling the model sinusoids in frequency, with or without envelope compensation respectively.

SUMMARY OF THE INVENTION

In consideration of the above-described needs in the art, and in consideration of the limitations of model-based approaches, a new method of signal modification and synthesis, with the capability of producing outputs of high subjective quality, has been developed. In this method, a set of candidate input sections is defined based on input transform-domain signal representations. A match-output transform-domain section is formed using the result of a matching process which compares candidate input sections to a reference section. The reference section for this matching process is defined based on one or more previously formed match-output sections. Main-output transform-domain signal representations are formed based on one or more match-output sections, whereby such main-output transform-domain signal representations can be inverse-transformed and combined with the output time-domain signal. This method is referred to as "Transform-Domain Match-Output Extension" (TDMOX).

The most essential feature of TDMOX is that the reference section for the matching process is based on one or more previously formed match-output transform-domain sections, instead of input signal sections. This is contrary to traditional methods of signal processing. Traditionally, when matching processes are used in the construction of signals, both reference and candidate are taken from the input, and the result is one or more model parameters. The present invention does not require the estimation of model parameters.

In a particular embodiment of the invention, the block transform method of Short-Time Fourier synthesis is used in constructing output signals. Output signals are constructed one frame at a time, with each new inverse-transformed frame being overlap-added into the time-domain output. FIG. 2C illustrates this arrangement for a constant time-domain synthesis shift of Ss samples per frame. Each of the time-scaled windows in FIG. 2C represents the inverse-transformation of a synthetic main-output spectrum. A main-output spectrum is a complex-valued function of frequency which can be obtained from a series of overlapping main-output sections. FIG. 1C is an illustration of overlapping output sections for a constant frequency-domain synthesis shift of Sf samples per section. The width of each section is Wf samples, and the width of each region of overlap is WOVf samples.

In a described embodiment of the invention, an uncompensated main-output spectrum is formed in a two-pass procedure, proceding on each pass from low frequency to high frequency, one match-output section at a time. FIG. 5 shows the major processing steps in the synthesis of one output frame, and gives a terminology for their respective inputs and outputs. In block 501, the input signal is windowed using a time-domain analysis shift Sa. FIG. 2B shows a sequence of analysis windows in the time domain and the corresponding sequence of analysis shifts; the computation of Sa is explained in the detailed description below. In block 502, the input segment is transformed into the frequency domain using an FFT algorithm. In block 503, a main input spectrum is flattened by dividing out its spectrum envelope, which is a cepstrally smoothed linear prediction transfer function. The envelope function is calculated from the input time-domain segment in block 513. In block 508, a compensated main-output spectrum is obtained from the uncompensated main-output spectrum by restoring the spectrum envelope. In block 509, the compensated main-output spectrum is inverse-transformed, again using an FFT. In block 510, the result of inverse transformation is overlap-added with previously synthesized components of the output time-domain signal.

Block 505 is the first pass from low frequency to high frequency. On the first pass, each reference section is obtained from the overlapping match-output section that is next-lower in frequency, as shown by the overlapping regions of FIG. 1C. Each set of candidate input sections is defined to cover a range of frequency shifts, as in FIG. 4A. The matching function for the first pass is similar to Eq. (5), except that candidate and reference sections are in magnitude form, dot products are replaced by scalar multiplications, and normalization by the square root of the energy product is employed. Each correlation function peak is quadratically interpolated to provide subsample accuracy. Block 504 computes the magnitude function that is used in defining candidate input sections.

Block 506 is the second pass from low frequency to high frequency. On the second pass, each reference section is a prediction based on the previous frame's second-pass match-output section, and each set of candidate input sections is defined to cover a range of time shifts. The method of prediction is to apply a linear phase shift to the previous frame's second-pass match-output section. The matching function for the second pass is similar to Eq. (6), except that sliding-time-reference candidate input sections are simulated by phase-shifting a set of first-pass match-output sections, rather than requiring an input spectrum to be measured or interpolated for each point in time. Only one input spectrum per time-domain synthesis shift is computed using the block-transform method. Linear phase shifts of this input spectrum approximate the separately measured candidate input sections of FIG. 4B.

Pitch scaling is obtained by resampling at one or more stages of processing. In other embodiments of the invention, there are several stages of data which could serve as input to a resampling operation, including time-domain input, frequency-domain input prior to a matching process, individual match-output sections, frequency-domain output after match-output sections have been combined, time-domain output, etc. In the described embodiment, first-pass match-output sections are resamplings of the flattened main-input spectrum. First-pass candidate input sections are obtained from a flattened input magnitude spectrum, without resampling. Second-pass candidate input sections are obtained by phase-shifting first-pass match-output sections, without resampling. In block 507, the uncompensated main-output spectrum is obtained from second-pass match-output sections by linearly interpolating across regions of overlap, without resampling.

FIGS. 1A, 1B, and 1C illustrate the relationship between first-pass candidate input sections and first-pass match-output sections, for the case of pitch raising by a factor of k=1.25. FIG. 1A depicts the log magnitude of an input spectrum, and its log spectrum envelope. FIG. 1B shows that the analysis section width, Wf/k, is smaller than the synthesis section width, Wf, for the case of k=1.25. In pitch raising, first-pass match-output sections contain more spectral samples than corresponding input sections, due to resampling. In pitch lowering, first-pass match-output sections contain fewer spectral samples than corresponding input sections. FIG. 1B also shows that the amount of overlap between input sections is not always equal to WOVf/k. In such an event, there is a "cutpoint" in the input spectrum. For pitch raising, the net contribution of input samples near a cutpoint is reduced, and some input samples may produce no contribution at all. For pitch lowering, the net contribution of input samples near a cutpoint is increased. Other features of FIG. 1B are explained in the detailed description below.

An extension of first-pass processing is further provided, in which an additional matching process is used to search over a localized range of pitch scaling factors. Candidate input sections for the additional matching process are resamplings of the flattened main-input spectrum, with the resampling factor being varied in a range about the inverse of the pitch scaling factor. The reference section for the additional matching process is the same as the second-pass reference section. An alternative method of defining second-pass reference sections is further provided, in which an additional forward transform is used to obtain a reference spectrum. In this method, the partially constructed output time-domain signal is windowed with a time-scaled analysis window, and subject to a forward transform. Reference sections are obtained directly from the resulting spectrum, with the spectrum envelope included. In this case, reference sections are based on the second-pass match-output sections of the previous frame, which are used in forming a main-output spectrum that contributes to the time-domain reference segment. Other features of the additional matching process and the alternative method of defining reference sections are explained in the detailed description below.

It should be appreciated that various changes to the methods described herein can be made by a person skilled in the art, without departing from the spirit and scope of the invention. For example, a variety of transformation techniques, other than the SwFr, have become available with recent developments in the field of digital signal processing, including polyphase-structured filter banks, modulated filter banks, and tree-structured subband methods such as wavelets. Furthermore, a number of analysis and synthesis parameters can be varied adaptively in response to signal characteristics. In block-transform methods, analysis window lengths can be varied in response to a measure of how rapidly the spectrum is changing. Also, the frequency-domain section width, Wf, and the frequency-domain synthesis shift, Sf, can be varied so as to contain energy peaks such as speech formants within a single section, thereby reducing the amount of cancellation within regions of overlap. For a fixed number of cutpoints, cutpoint frequencies can be varied for a similar effect. This type of arrangement is particularly appropriate for playing back compressed audio signals with modification: audio bitstreams often contain encoded information about formants or strong harmonic peaks, which can be used to control parameters like Wf and Sf automatically. If an input signal has been compressed using transform-domain coding, playback of modified signals does not require the forward transform operation, since coded information is already available in a transform-domain format.

The methods of the present invention are especially intended for the processing of stored input signal representations, and in particular for the processing of compressed input signal representations, although they are next described in the context of a real-time, low-delay system which incorporates an AID converter. In particular, a general-purpose speech synthesizer can operate by concatenating recorded segments, and by smoothing the transitions between segments in various ways to provide more natural-sounding output. The present invention permits time-varying pitch and time-scale modifications to be integrated with such a process of retrieval, concatenation, and smoothing. With regard to the methods of the described embodiment, concatenation is obtained by switching from one input signal to another. Smoothing is obtained by switching inputs gradually over time, and by cross-fading between their respective outputs. Time-varying pitch modification is obtained by using different pitch scaling factors from one synthesis frame to the next (for a given input), and time-scale modification is obtained by using different candidate input time indices (for a given input). The methods of the present invention are also especially intended for network server applications, in which main-output transform-domain signal representations can be compressed and transmitted over a network. In such applications, compressed transform-domain data is typically buffered for some length of time prior to transmission, and not used in constructing time-domain output until some time after transmission, at a remote location.

It is moreover possible to reorder some processing steps, and to include others not described herein, without departing from the spirit and scope of the invention. Resampling operations which lead to pitch modification can be placed at a variety of junctures in the processing, depending upon the details of an implementation, depending upon whether pitch is being raised or lowered, etc. Pitch modification can be integrated with time-scale modification and/or spectrum envelope modification. Spectrum flattening and envelope compensation can be placed inside matching processes, or omitted altogether. In a more sophisticated system, moving envelope compensation into the matching process leads to an improved matching criterion: by compensating each candidate input section in a slightly different manner, and by using reference sections which include the effect of the output envelope, candidate sections are made more representative of potential output sections at the cost of increased computational effort. In this case, it is logical to form the reference section directly from main-output signal representations. It should be appreciated that a reference section based on main-output signal representations is also a reference section based on match-output transform-domain sections.

Matching processes can be reordered to take advantage of known properties of auditory perception, to obtain increased efficiency, to split searches into multiple resolutions, etc. Matching processes can also be combined into a single, multidimensional matching process.

Multidimensional function maximizations such as the direction-set, conjugate gradient, or simplex methods can be used, given a measure of transform-domain similarity such as the cross-correlation. Many parallel processing methods have also been described in the literature. Of particular interest in linear-frequency-axis methods are algorithms which can be used to search over ranges of shifts in both frequency and time simultaneously: with multiprocessor, multiple-issue, and single-instruction multiple-data (SIMD) architectures becoming more prevalent in the microprocessor industry, parallel search algorithms become more cost-effective to implement.

According to the methods of the present invention, main-output transform-domain signal representations are formed based on one or more match-output transform-domain sections. It should be appreciated that various processing actions can be inserted between the formation of a match-output representation and the formation of a main-output representation, without departing from the spirit and scope of the invention. For example, a filtering operation may be integrated for added effect, an externally supplied signal may be mixed into the output, resampling for the purpose of pitch scaling may be inserted, etc. In the described embodiment, cascaded search operations have been inserted; In a particularly simple embodiment of the present invention, only one of the three described matching processes would be used. Processing actions can likewise be inserted prior to the definition of candidate input sections, or prior to the definition of a reference transform-domain section.

Processing elements may furthermore form match-output transform-domain sections one datum at a time, in such a way that each datum is destroyed before the next is obtained, or before the datum is ever commited to storage. The real part of a complex sample can also be destroyed before the imaginary part is formed. For example, a programmable digital signal processor (DSP) can be configured to calculate main-output spectra directly from an input spectrum representation, resampling the Input spectrum and using linear Interpolation across regions of output section overlap. The DSP can read an input datum from memory into a general-purpose register, scale it by an interpolation coefficient, add the product to an accumulator, and eventually store the accumulator value back to memory. In this case the match-output datum, ie the datum that is read from memory, will be distinct from input spectral data for an exceedingly short period of time, typically on the order of five nanoseconds for a 200 MHz DSP, and will be destroyed before the next datum is obtained.

According to the methods of the present invention, match-output transform-domain sections are formed based on a selection result. In general, the selection result is an indication of which candidate input section is representative of an input transform-domain region from which to form the match-output transform-domain section. The match-output transform-domain section is formed from this region of input. It should be appreciated that match-output sections need not be identical to any of the candidate input sections. For example, in the first pass of the described embodiment, candidate input sections are in magnitude form, while match-output sections are in complex-valued form. These match-output sections are moreover resampled at a rate that is a function of pitch scaling factor, and are resampled using an initial subsample offset that is provided by quadratic interpolation of the cross-correlation function peak (the input to the resampling operation would also qualify as a match-output section, although it is not referred to as such in the detailed description). It should further be appreciated that match-output sections can be formed as a byproduct of the matching process. For example, if candidate input sections are double-buffered, and if the selection result is obtained by finding the largest measure of similarity in a sequence of candidates, it is possible to avoid overwriting the candidate input section corresponding to the selection result. If match-output sections are identical to candidate input sections, it is thus possible to store a match-output section before the selection result is obtained.

It should be appreciated, furthermore, that a variety of prediction methods may be used in defining reference sections. In particular, it is possible to predict a fixed-time-reference spectrum using main-output spectra from more than one previous frame, and then phase-shift the predicted spectrum by the appropriate amount. The method of windowing the partially constructed output time-domain signal with a time-scaled analysis window, and applying a new forward transform, is also a method of prediction. In such a case, the predicted reference will have more time resolution and less frequency resolution than the candidate sections it is compared with.

BRIEF DESCRIPTION OF THE DRAWINGS

FIG. 1A shows the log magnitude of a short-time Fourier spectrum and its corresponding spectrum envelope. FIG. 1B shows a series of overlapping analysis sections in relation to the input spectrum. FIG. 1C shows a series of overlapping synthesis sections in relation to the input spectrum.

FIG. 2 A shows an input waveform. FIG. 2B shows a series of overlapping analysis windows in relation to the input waveform. FIG. 2C shows time-scaled analysis windows which represent a series of overlapping synthesis segments in relation to the input waveform.

FIG. 3A shows two windowing functions being applied to a time-domain input signal. FIG. 3B shows a candidate segment. FIG. 3C shows a reference segment. FIG. 3D shows a windowing function being applied to a time-domain output signal. FIG. 3E shows a candidate segment from the input signal of FIG. 3A. FIG. 3F shows a reference segment from the output signal of FIG. 3D.

DETAILED DESCRIPTION

Figure 6:
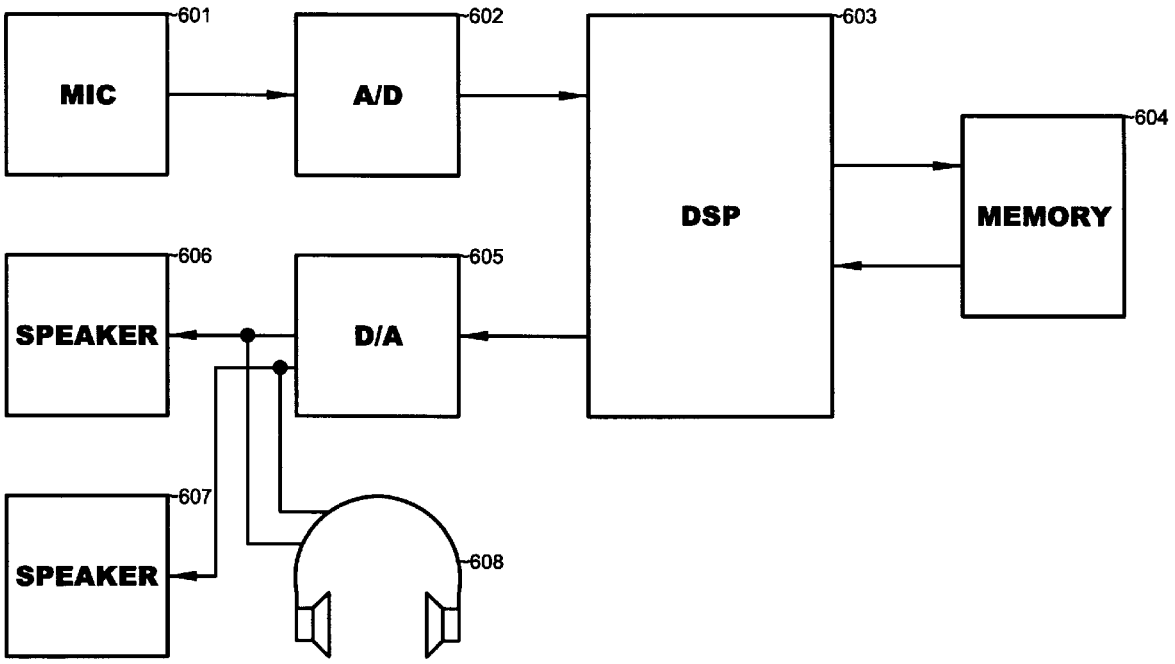
FIG. 6 is the hardware block diagram of a real-time, low-delay signal modification system that is implemented on a general-purpose, programmable Digital Signal Processor.

The described embodiment of the present invention is a real-time, low delay system for pitch modification. FIG. 6 shows a hardware block diagram for such a system. An audio signal received from microphone 601 is digitally sampled by AID converter 602, which periodically interrupts the general purpose DSP 603. On each AID interrupt, the general purpose DSP 603 stores a new sample into a circular input buffer located in digital memory 604. Also located within digital memory 604 (or equally well in a different memory accessible to general purpose DSP 603) is a circular output buffer, from which samples are retrieved by an interrupt mechanism associated with D/A converter 605. The output of D/A converter 605 drives a speaker 606, producing an audible output signal that is a pitch-modified version of the input signal. Headphones 608 may be substituted in place of the pair of speakers 606 and 607. For stereo signals, the AID converter 602 produces multiplexed left and right digital input signals, the D/A converter 605 produces multiplexed left and right digital output signals, and the input and output circular buffers are maintained separately for each channel.

A/D and D/A processes are synchronized to one another by an externally supplied clock signal, and both operate at the same sample rate. Input and output circular buffers are the same size (1024 samples for a 11.025 kHz sampling rate), and there is a predefined circular offset between each input circular buffer pointer and the corresponding output circular buffer pointer. A description of the processing required for one output channel is given below; additional concurrent output and/or input channels are implemented in the same manner, using pointers into different input and output circular buffers. The tasks for different channels maintain state variables and intermediate data in separate areas of memory, and are interleaved by the task-switching mechanism of a real-time operating system (RTOS). Task interleaving insures that groups of output samples for different output channels become available at approximately the same time, allowing a smaller system delay than would be possible if the tasks for different channels were executed sequentially. The RTOS also insures that a system delay constraint is met. The system delay constraint is given by the predefined circular offset between input and output buffer pointers.

Running on the general purpose DSP 603 is a software program that repeatedly synthesizes an output segment and overlap-adds this segment into the output circular buffer, using a fixed time-domain synthesis shift. For each frame, the output segment is obtained by inverse Fourier Transformation of a main-output spectrum. Also for each frame, a main input spectrum is obtained by Fourier Transformation of a Hanning-windowed region of the input time-domain signal. The time-domain analysis shift, ie the displacement between successive windowed regions of the input signal, consists of a fixed component which is computed from the pitch scaling ratio and the time-domain synthesis shift, plus a variable component which is measured with a time-domain matching process. The time-domain analysis shift is a displacement between samples in the circular input buffers of digital memory 604, and the time-domain synthesis shift is a displacement between samples in the circular output buffers of digital memory 604.

The details of the system for pitch modification may be understood by referring to the remaining figures. Processing actions for each new synthesis frame are handled by one iteration of the main loop in FIG. 7. The main loop involves deciding the variable component of the time-domain analysis shift 701,702,703, updating input and output sample indices 704,707, windowing the input signal at an appropriate analysis shift 701,704, performing transformations and frequency-domain processing 705, and overlap addition with the output time-domain signal 706. The input sample index finbsamp, the output sample index foutbsamp, and an accumulated offset acc_offset are initialized in a block of operations 700 that precedes the main loop. acc_offset is the accumulated offset between finbsamp and foutbsamp in samples, where finbsamp and foutbsamp are pointers into the input and output circular buffers respectively. The address from which samples are sent to D/A conversion is kept close to and before foutbsamp, and the address to which samples from A/D conversion are written is kept close to and after finbsamp plus the Hanning window length.

A C-language software program accompanies the figures. The input data is taken to be a 16-bit digital signal with a sample rate of 11.025 kHz (ie, one fourth the standard Compact Disc rate of 44.1 kHz). The variable gfour_samplerate=11.025 kHz and other related variables are defined under the heading "globals." The analysis Hanning window length is gfour_frametime=30.0 msec, corresponding to gfour_samplesperframe=330.75 samples. The pitch scaling factor is gpitchfactor=1.25, which produces a 25% increase in pitch. The inverse of the pitch scaling factor is herein referred to as the pitch inverse factor. The time-domain synthesis frame step is set to one fourth the effective synthesis frame length, or gfour_framestep=0.25 (30.0 msec/1.25)=6.0 msec, corresponding to a time-domain synthesis shift of gfour_samplesperstep=66.15 samples.

Figure 7:
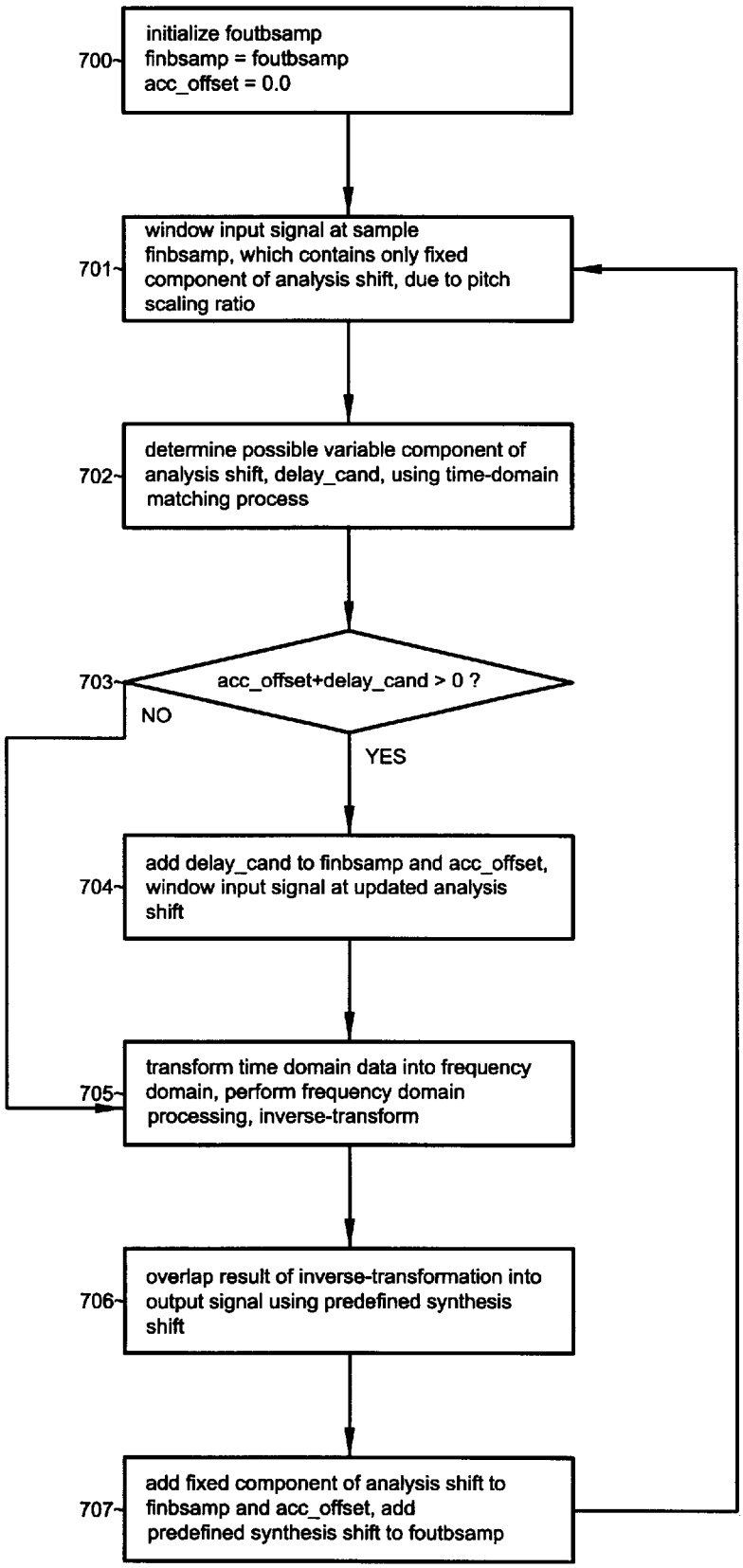
FIG. 7 is a block diagram showing the control flow and processing actions in the main loop of a described embodiment of the invention.

The operations of FIG. 7 correspond to subtask map_mono_jourfer() in the program listing. The block 701 first windows the input signal at the analysis shift corresponding to zero variable component, ie at the fixed component due to pitch scaling ratio and time-domain synthesis shift. This input segment is stored in the array fourframe. A time-domain matching process 702 then determines a possible variable component of the analysis shift, delay_cand, by comparing fourframe to other similarly windowed regions of the input signal using a normalized cross-correlation. Subtask find_delay_cand( . . . ) implements this time-domain matching process. The range of shifts considered by find_delay_cand( . . . ) is determined by global variables gchtmin and gchtmax. In pitch raising, the fixed component of the time-domain analysis shift is positive, and delay_cand is required to be negative. In pitch lowering, the fixed component of the time-domain analysis shift is negative, and delay_cand is required be positive.

Block 703 decides whether it is fourframe or the windowed input region corresponding to delay_cand that is transformed into frequency-domain input. Whenever acc_offset is sufficiently far away from zero, delay_cand is added to acc_offset, and fourframe is replaced with the windowed input region corresponding to delay_cand, 704. Otherwise, the original contents of fourframe are utilized. If there is any change in acc_offset, the input sample index finbsamp is also updated, 704. For pitch raising, acc_offset is always kept greater than zero. For pitch lowering, acc_offset is always kept less than zero. Block 705 transforms the data in fourframe into the frequency domain, performs frequency-domain processing operations, and inverse-transforms to get back to the time-domain. Block 706 overlap-adds the result into the output signal using the time-domain synthesis shift. Block 707 adds the time-domain synthesis shift to the output sample index, foutbsamp, and adds the fixed component of the time-domain analysis shift to the input sample index, finbsamp.

The one-dimensional arrays fourframe and mappedframe, corresponding to input and output segments respectively, are allocated using a function vector( . . . ) from a software library supplied by W. H. Press, S. A. Teukolsky, W. T. Vetterling, and B. P. Flannery in the text "Numerical Recipes in C, Second Edition," which is incorporated herein by reference. The arrays fourframe and mappedframe are deallocated using a function free_vector( . . . ) from this library. Two two-dimensional arrays are also allocated and deallocated, using the functions matrix( . . . ) and free_matrix( . . . ) from the aforementioned library: currfdseg[][] provides memory for a series of match-output sections, and prevfdseg[][] contains the previous frame's currfdseg[][] information, adjusted by the linear phase shift gfour_samplesperstep (see discussion of FIG. 9, block 909).

Figure 1A:
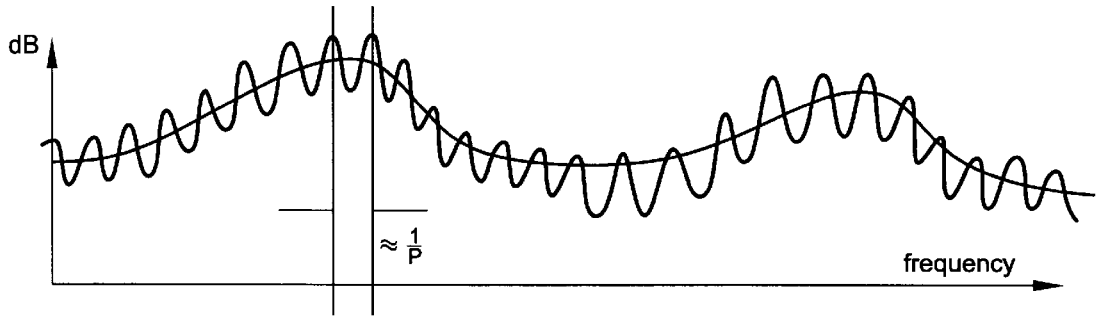
FIGS. 1A–1C are an illustration of the relationship between analysis sections and synthesis sections in the frequency domain.
Figure 1B:
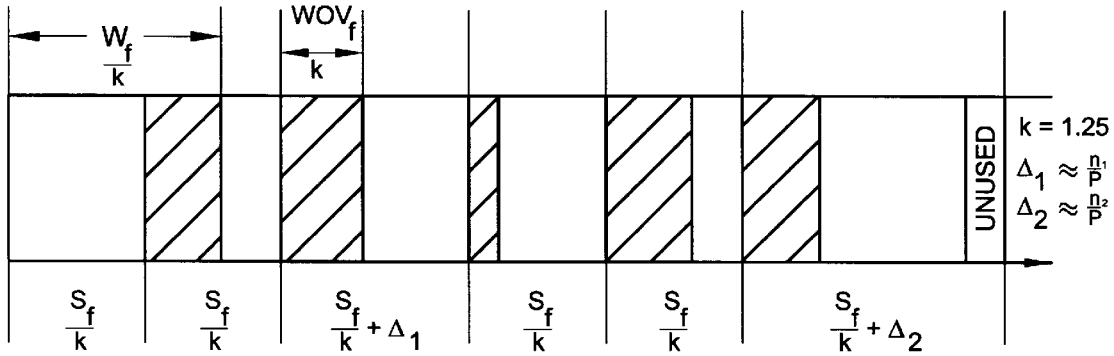
Figure 1C:
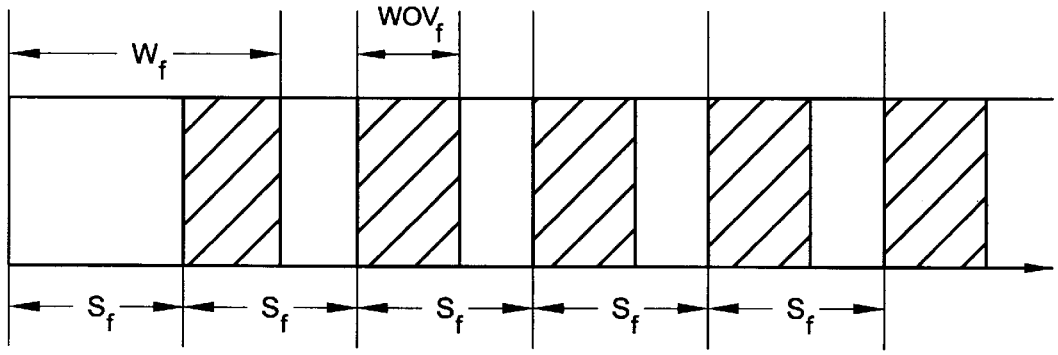
Figure 2A:
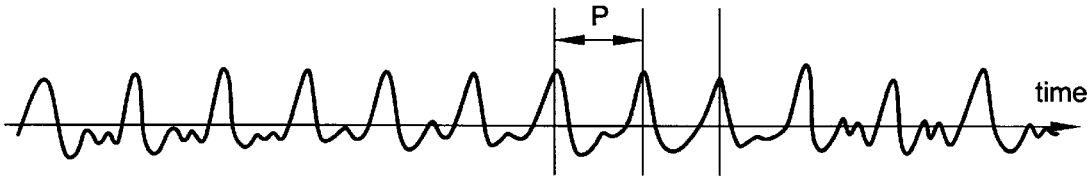
FIGS. 2A–2C are an illustration of the relationship between analysis segments and synthesis segments in the time domain.
Figure 2B:
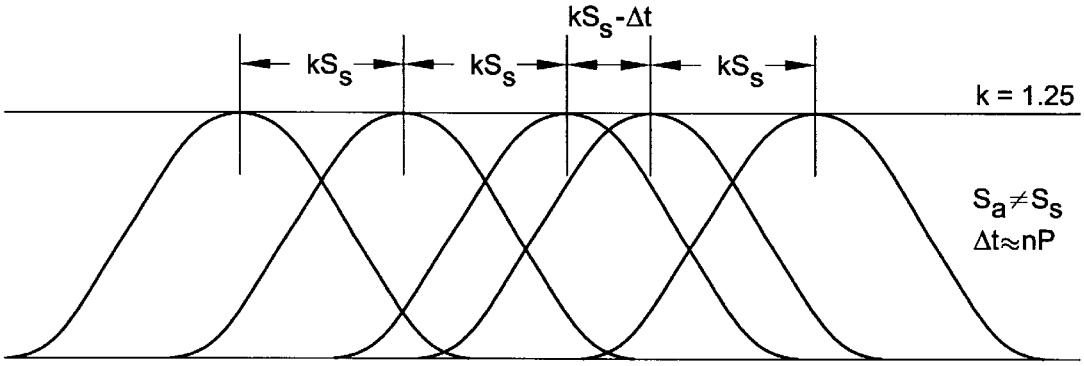
Figure 2C:
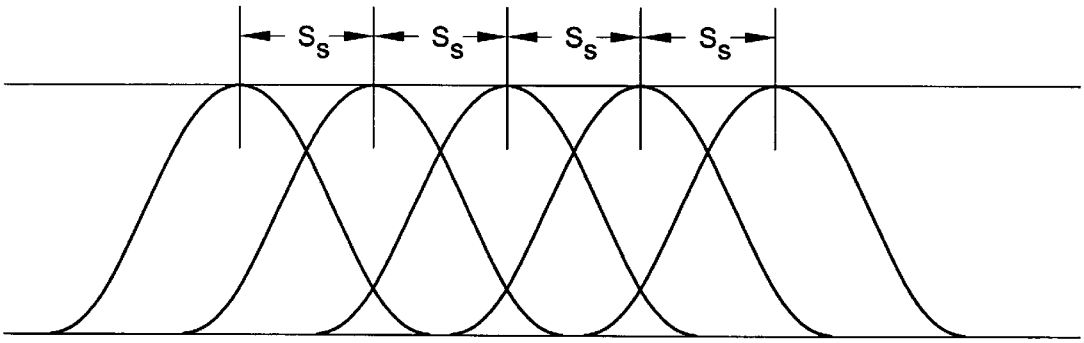
Figure 3A:
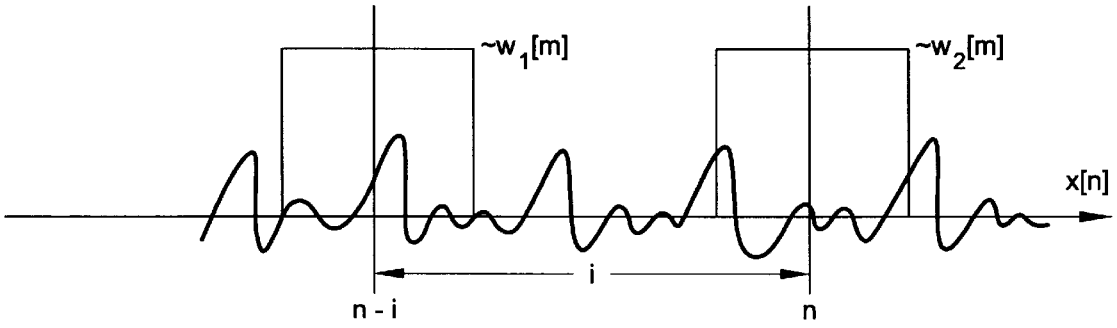
FIGS. 3A–3F are an illustration of windowing operations for a matching process in the time domain.
Figure 3B:
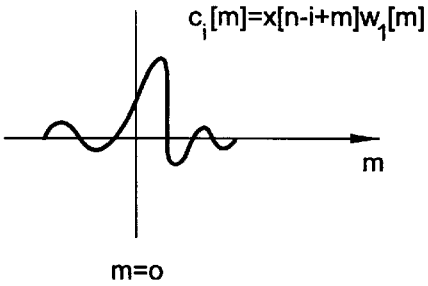
Figure 3C:
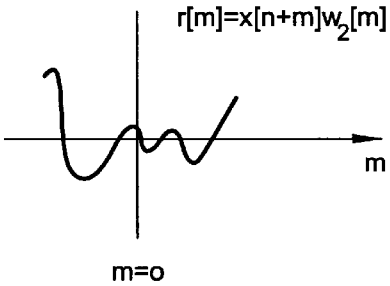
Figure 3D:
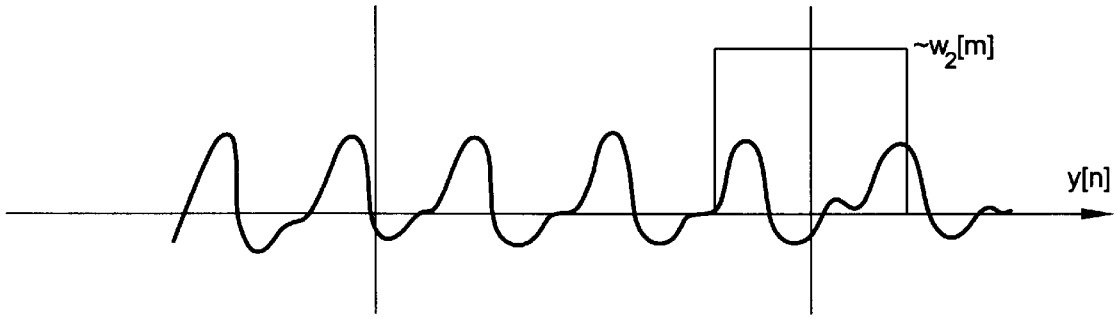
Figure 3E:
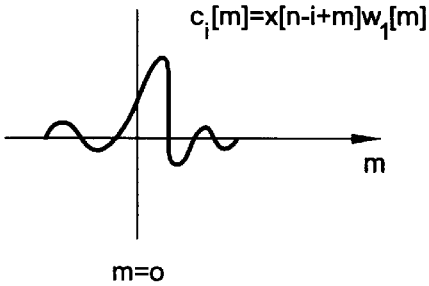
Figure 3F:
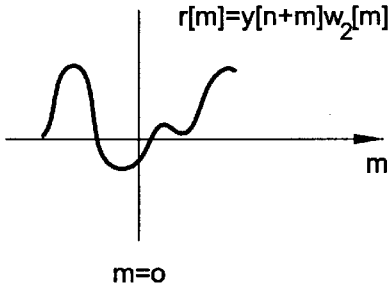
Figure 4A:
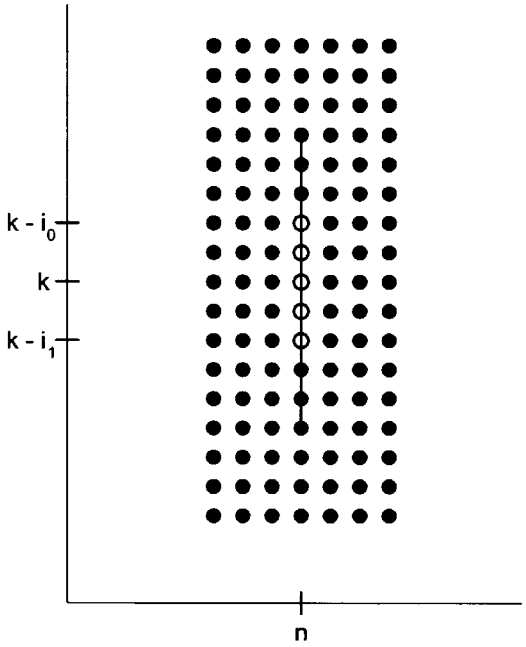
FIGS. 4A–4D are an illustration of ranges of candidate input sections. Each circle is a sample in a frequency-domain representation. Connected circles are used in forming one or more candidate input sections, and each open circle is the center sample of a candidate input section.
Figure 4B:
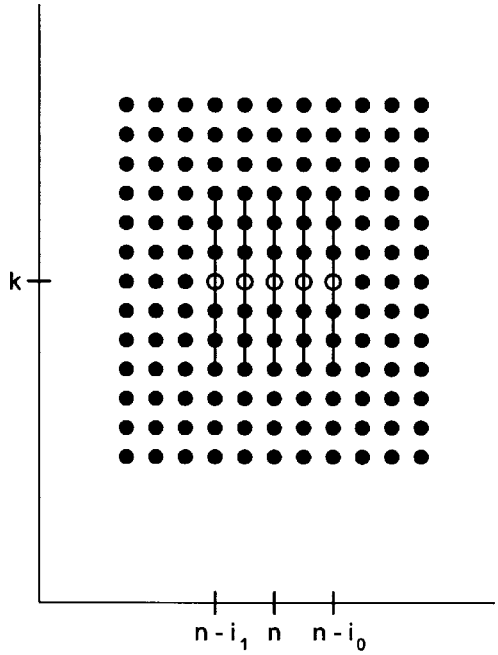
Figure 4C:
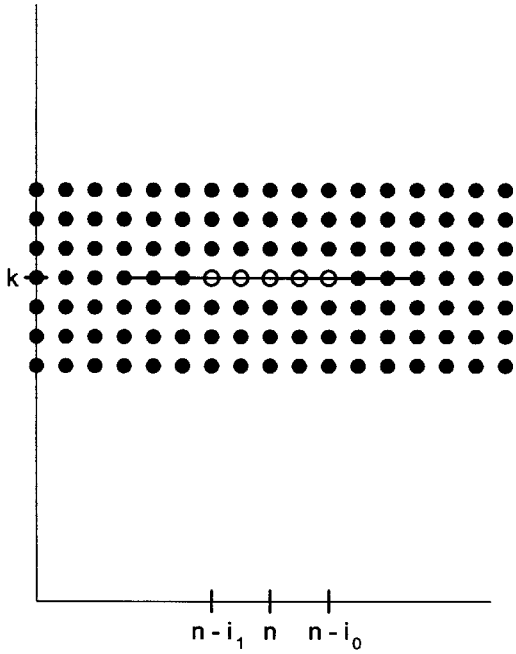
Figure 4D:
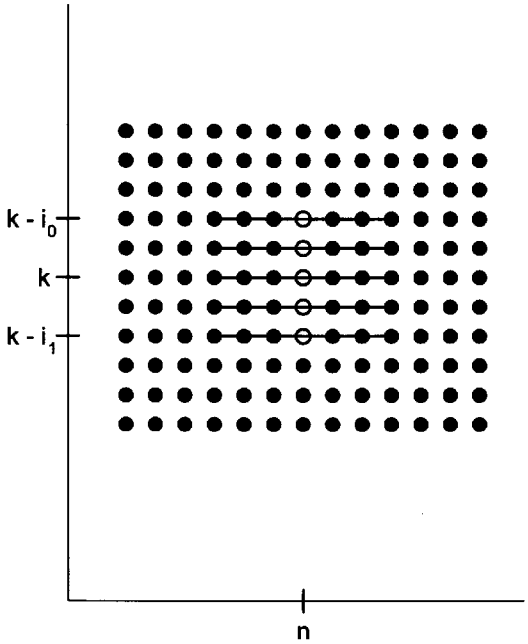

The first index in each two-dimensional array is the index of a match-output section, beginning with index zero for the lowest-frequency section, and proceeding up to index rfinal for the highest-frequency section. The variable Wf contains the width of a match-output section in frequency-domain samples. The second index in each two-dimensional array ranges from 0 to 2Wf-1; each frequency-domain sample is complex-valued. The variable Sf contains the frequency-domain synthesis shift, and the difference WOVf=Wf−Sf is the amount of overlap between sections. Wf and Sf are controlled by global variables gWf and gSf respectively, and are approximately proportional to the pitch scaling factor. FIG. 1C is a frequency-domain diagram showing the quantities Wf, St, and WOVf. In the described embodiment, Sf and Wf are the same for each section index, and do not depend on the input signal.

Figure 5:
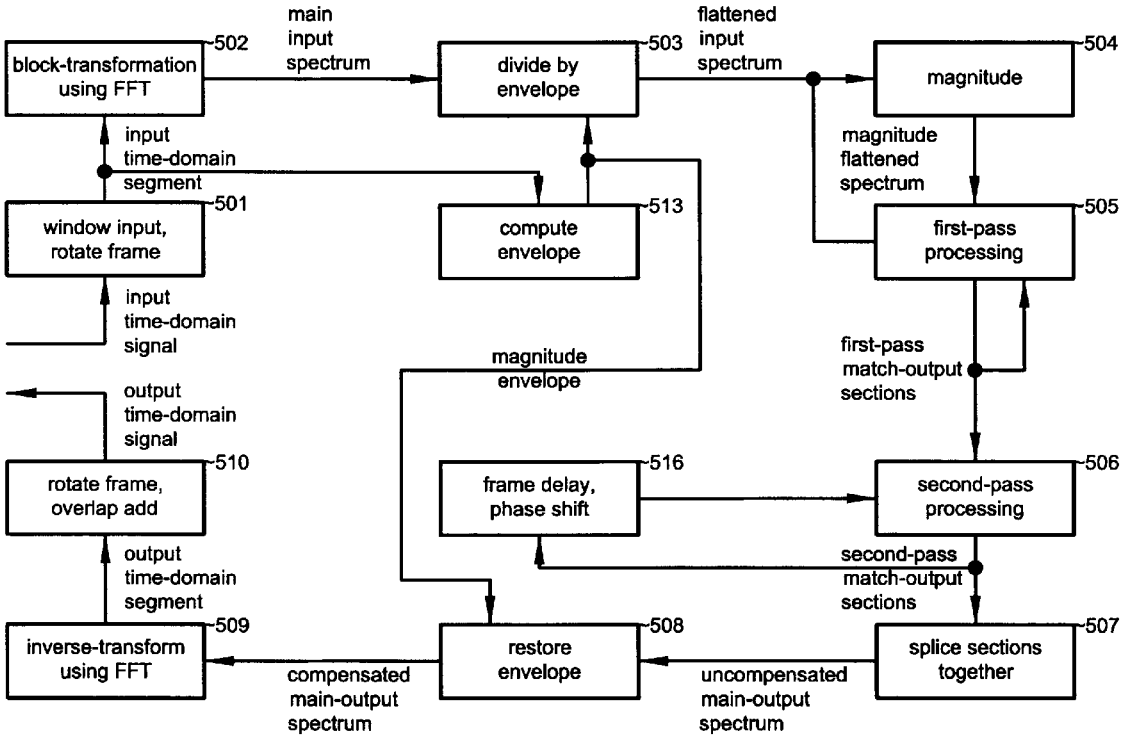
FIG. 5 is a block diagram of the processing steps in the synthesis of one output frame in a described embodiment of the invention, and provides a terminology for their respective inputs and outputs.
Figure 8:
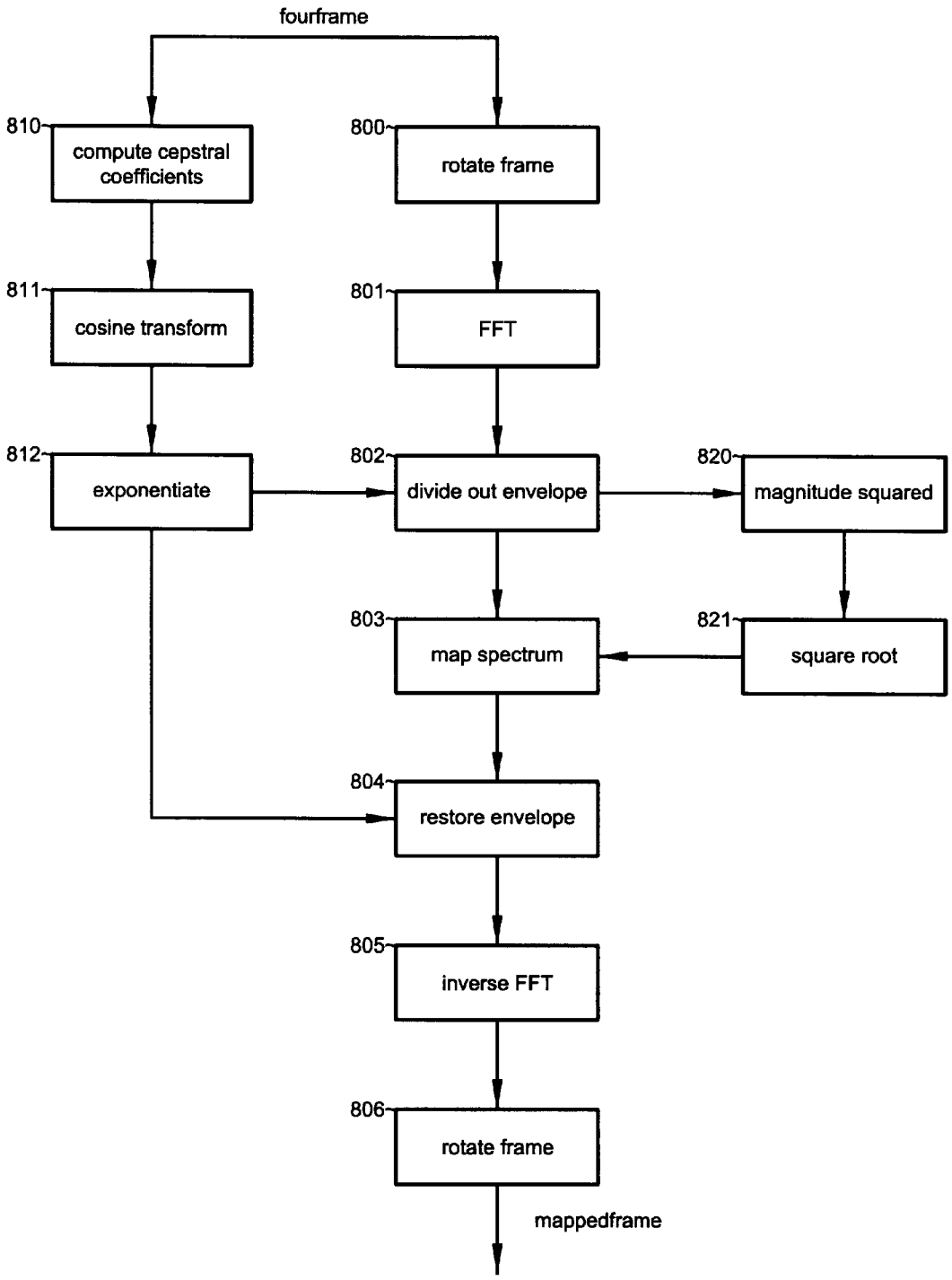
FIG. 8 is a block diagram showing an expanded view of block 705 of FIG. 7.

FIG. 8 details the operation of block 705 of FIG. 7, which also corresponds to blocks 502 through 509 of FIG. 5. Subtask shorttimeiteration( . . . ) implements the operations of FIG. 8. The main processing path begins with a block 800 that circularly rotates the input segment in place, so that the time-domain sample scaled by the center of the Hanning window is aligned with the beginning of the array fourframe. This rotation of the input segment produces smoother phase functions, and hence spectra that are more amenable to interpolation. Adjacent complex exponentials of like phase reinforce at array index zero (mod fftsize) and cancel at array index fftsize/2. Conversely, centering the input segment at time index zero tends to produce phase functions which are smoother, leading to spectra that are more suitable for interpolation. Block 806 performs the inverse rotation on mappedframe.

Block 801 implements a 1024-point in-place FFT, using the function realft( . . . ) from the aforementioned software library. The function realft( . . . ) takes a real-valued 1024-point segment as input, and produces a complex-valued 513-point spectrum as output. The zeroth and 513th spectral samples are real-valued, and are stored in the first two locations of fourframe. The remaining spectral samples are complex-valued and are stored as pairs of consecutive components in fourframe, real components followed by imaginary components Block 805 shows the inverse transformation, which is also implemented by the function realft( . . . ).

Block 802 flattens the main input spectrum by dividing out its magnitude envelope, and block 804 restores the magnitude envelope, inverting the operation of block 802. The envelope is calculated using the well-known autocorrelation method of linear prediction. Block 810, implemented by subtask compute_Ipc_frame( . . . ), computes a set of 16 predictor coefficients and converts these into a set of 24 cepstral coefficients. Block 811 then cosine-transforms the cepstral data into a 513-point log magnitude envelope, using the function cosftl( . . . ) from the aforementioned software library. Block 812 produces a magnitude envelope by exponentiating the output of block 811.

The output of block 802, still in fourframe, is the primary input to block 803, which is implemented by subtask map_excitation( . . . ). The primary output of map-excitation( . . . ) is mappedframe, which is also the output of blocks 804 through 806. A second input to map_excitaton( . . . ) is provided by the array magnitude: the magnitude of the flattened input spectrum is used in defining candidate input sections for first-pass matching processes The magnitude of the flattened input spectrum is computed by blocks 820 and 821, by first summing the squares of real and imaginary components, and then taking square roots.

Figure 9:
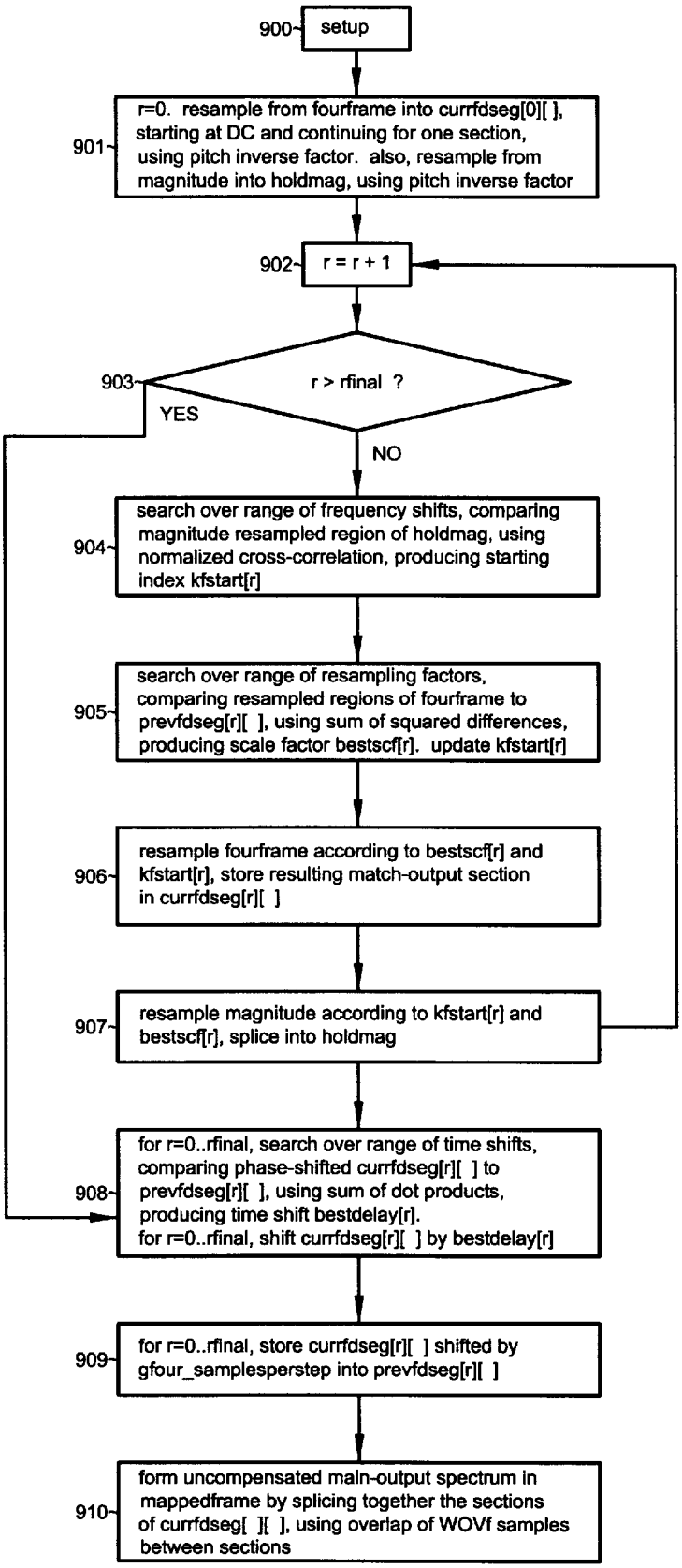
FIG. 9 is a block diagram showing an expanded view of block 803 of FIG. 8.

FIG. 9 details the operation of block 803, which also corresponds to blocks 505 through 507 of FIG. 5. Subtask map-excitation( . . . ) implements the operations of FIG. 9. In blocks 900 through 910, an uncompensated main-output spectrum is constructed from the flattened input spectrum in a two-pass procedure, utilizing three different matching processes. The flattened input spectrum is contained in fourframe, and the uncompensated main-output spectrum is stored into mappedframe. After each pass, a series of match-output sections is contained in currfdsegf [][]. Blocks 900 through 907 correspond to first-pass processing operations, and block 908 corresponds to second-pass processing operations. Block 909 implements the one-frame delay and linear phase shift of block 516. At the end of map_excitafion( . . . ), Block 910 forms mappedframe by adding together the match-output sections in currfdsegt[r][], r=0 . . . rfinal, with an overlap of WOVf samples between sections.

After the initializations of block 900, block 901 sets the section index equal to zero, resamples the section-zero region of fourframe into currfdseg[0][], and resamples the section-zero region of magnitude into a temporary array, holdmag. No search over frequency shifts is performed in this step; section-zero resamplings are defined by the pitch inverse factor with zero frequency shift. In general, holdmag contains the magnitude function that results from splicing together candidate input sections that correspond to currfdseg[][], for all match-output sections so far obtained, using an overlap of WOVf samples between sections. In searching over a range of frequency shifts, the algorithm forms a reference magnitude section from holdmag by inverting the resampling operation. The arrays magnitude and holdmag have been referred to as xbase and ybase respectively within subtask map_excitation( . . . ), since other functions could be substituted in their place.

Loop control is performed by blocks 902 and 903, which increment the section index r until all match-output sections have been obtained. Block 904 performs the search over a range of frequency shifts; a detailed discussion is given below. The net result of this search is a starting frequency index kfstart[r]. Block 905 performs the extension of first-pass processing, in which an additional matching process is used to search over a localized range of pitch scaling factors, comparing to the like-frequency section of the preceding output frame; a detailed discussion is given below. The net result of this search is a scale factor bestscf[r], and an update to kfstart[r]. Block 906 resamples fourframe into currfdseg[r][], using kfstart[r] and bestscf[r]. Block 907 resamples the array magnitude and splices the resulting magnitude section into holdmag, again using kfstart[r] and bestscf[r]. Block 908 performs the search over a range of time shifts, again comparing to like-frequency sections of the preceding output frame. Block 909 updates prevfdseg[][] by applying the linear phase shift gfour_samplesperstep to the match-output sections of currfdseg[][]. Block 910 forms the main-output spectrum, by splicing together match-output sections in currfdseg[][]. Blocks 908, 909, and 910 all have separate loops going from r=0 to r=rfinal.

In block 904, the search over a range of frequency shifts is performed using a normalized cross-correlation function, followed by subsample interpolation of the cross-correlation peak. Block 904 begins by determining the minimum and maximum frequency offsets to be tested, ileft and iright. In most cases, a search range covering ±ccshiftmax frequency-domain samples is employed; however, the extreme high-frequency and low-frequency sections require special-case processing, as shown. When ileft=−iright, the variable na=r*Sf contains the starting input frequency index for the candidate at the center of the search range. For example, starting input frequency indices for section 4 are 4*Sf+ileft through 4*Sf+iright. Block 904 next determines whether starting input frequency index poss_kfstart is contained within the range to be searched; poss_kfstart is the starting input frequency index that corresponds to a simple continuation of section r−1. In first-pass processing, a result of kfstart[r]=poss_kfstart is equivalent to eliminating section r, while increasing the width of section r−1 from Wf to 2*Wf−WOVf.

If poss_kfstart is within the range na+ileft . . . na+iright, the first-pass matching process is omitted for section index r, since the normalized cross-correlation would necessarily reach a maximum when the two sections being compared are identical. In such a case (and also in the special case where fewer than Wf match-output samples remain to be determined), kfstart[r] is set to poss_kfstart, and no cross-correlations are computed. Otherwise, a reference section is obtained by resampling holdmag beginning at frequency index rSf=reSf. The width of the reference section is ccwidth, which has been set to gWOVf−1 in block 900. The value of ccwidth=gWOVf−1 input magnitude samples requires a width of slightly less than WOVf samples from holdmag.

The next step in block 904 is to compute the energy of the reference section, and the energy of the candidate input section beginning at frequency index na+ileft. These values are stored as energyy and energyx respectively. A cross-correlation with the reference section is computed for each starting input frequency index na+i, i=ileft . . . iright, and is normalized by the square root of the product of section energies. The value of energyy stays fixed, whereas the value of energyx is updated for each i. The peak normalized cross-correlation is maintained in ccpeaksum, and the frequency shift associated with ccpeaksum is maintained in ipeak.

The final step in block 904 is to quadratically interpolate the cross-correlation function peak to provide a subsample offset, tract_offset. The formula for fract_offset is obtained by equating the derivative of a quadratic equal to zero, ie the unique quadratic which passes through each of the three normalized cross-correlation values centered about the maximum. For the cases in which kfstart[r] is not set to poss_kfstart, ifstart[r] is computed as na+ipeak+fract_offset. it the search over a range of shifts were the only matching process used, currfdseg[r][] would be formed by resampling fourframe, beginning at kfstart[r], using the pitch inverse factor.

Block 905 implements a matching process that searches over a range of resampling factors centered about the pitch inverse factor, comparing candidate sections to the like-frequency second-pass match-output section of the preceding output frame. Reference sections are computed and stored into prevfdseg[r][] by block 909 using a method described below. Subtask compare_idseg_scf( . . . ) implements the matching process and returns a best scale factor in bestscf[r].

Within compare_fdseg_scl( . . . ), each candidate section's starting input frequency index is calculated as kf=kfcenter+ic*scf, where scf is the resampling factor, and spectrum scaling is with respect to frequency index kfcenter. Ic Is a scalar chosen so that kf=kfstart[r], as output by block 904, when scf is equal to the pitch inverse factor. kfcenter=0, so that spectra are scaled with respect to DC. The number of different resampling factors considered is ndivs, and the values of sci are evenly spaced on a geometric scale between basescf/maxscfrat and basescf*maxscfrat, where basescf is equal to the pitch inverse factor. As long as ndivs is odd, one of the candidate sections will be a resampling of fourframe that begins at kf=ifstart[r] and uses the pitch inverse factor. Whenever scf<1.0, kf<kfstart[r]. Whenever scf>1.0, kf>kfstart[r].

For each div in the range 0 . . . ndivs-1, a comparison is made between prevfdsdg[r][] and the candidate section corresponding to resampling factor scf, over a width of Wf complex samples. The matching function is a sum of squared differences, which is a measure of dissimilarity rather than a measure of similarity. For each candidate section, an error measure is defined as the sum of the squares of the magnitudes of the complex differences between candidate and reference section samples. The error sum is obtained by summing together the squares of the real differences and the squares of the imaginary differences. This arrangement takes advantage of Parseval's theorem, which states that the sum of the squares in the frequency domain is equal to the sum of the squares in the time domain, to within a scaling constant. It is therefore possible to compute what is in effect a time-domain error sum using a relatively small number of terms in the frequency domain. The minimum sum of squares is maintained in minsqerror, and the scf associated with minsqerror is maintained in bestscf[r].

The matching process of subtask compare_fdseg_scf( . . . ) is omitted if the flag gfirstframe is set, since in this case there is no preceding frame, and prevfdseg[r][] does not contain valid data. This matching process is also omitted whenever the section index r is less than a predefined threshold, gstartadj_r. If the matching process is omitted, bestscf[r] is set to the pitch inverse factor. Finally in block 905, kfstart[r] is updated to kfcenter+lc*bestscf[r]. Block 906, implemented by subtask getfdseg_scf( . . . ), retrieves the match-output section corresponding to bestscf[r] and kfstart[r], and stores this in currfdseg[r][]. Block 907 updates holdmag, by resampling the array magnitude according to bestscf[r] and kfstart[r], and splicing this into holdmag. The splicing weights splicewx[m] and splicewy[m] are linear ramps with the property that splicewx[m]+splicewy[m]=1.0, for m in the range 0 . . . WOVf-1. This concludes first-pass processing.

In block 908 subtask find_bestdelay_fdseg( . . . ) performs the search over a range of linear phase shifts, comparing candidate input sections to like-frequency second-pass match-output sections from the preceding output frame. For r=0 . . . rfinal, a subtask compare_fdseg_linphase( . . . ) compares the candidate input section $e^{i2\pi km/N}$ currfdseg[r][k-r*Sf] to the reference section prevfdseg[r][k−r*Sf], where N=fftsize, time delay m covers the range basedelay :tmaxdelay, and frequency index k covers the range r*Sf . . . r*Sf+nk. maxdelay=20 samples, basedelay=0 samples, and nk=Wf except when there are fewer than Wf match-output samples remaining to be determined. The quantity $e^{i2\pi km/N}$ is the linear phase shift for time delay m. The matching function is similar to Eq. (6), except that sliding-time-reference candidate input sections have been simulated by the candidate section, $e^{i2\pi km/N}$ currfdseg[r][k−r*Sf]. For each candidate section, the sum of the dot products between candidate and reference section samples is obtained by summing together the products of the real components and the products of the imaginary components. The largest sum of dot products is maintained in maxdpsum, and the value of m associated with maxdpsum is maintained in bestdelay[r].

The nth roots of unity, $e^{i2\pi km/N}$, are contained in a lookup table gnthrootslut[m], m=0 . . . N−1, with real components preceding imaginary components. The value of km (modulo N) is computed using logical AND, doubled to account for the fact that lookup table entries are complex, and used in indexing the lookup table. The matching process of subtask compare_fdseg_linphase( . . . ) is omitted if the flag gfirstframe is set, since in this case there is no preceding frame, and prevfdseg[r][] does not contain valid data. This matching process is also omitted whenever the section index r is less than the predefined threshold, gstartadj_r. If the matching process is omitted, bestdelay[r] is set to zero. The last step in block 908 is to form second-pass match-output sections by multiplying each currfdseg[r][k−T*Sf] by the linear phase shift $e^{i2\pi k(bestdelay[r])/N}$, again for frequency index k in the range r*Sf . . . r*Sf+nk. For r=0 . . . rfinal, subtask timeshift_fdseg( . . . ) performs this task. This concludes second-pass processing.

Block 909 utilizes subtask timeshift_fdseg( . . . ) to compute prevfdseg[r][k−r*Sf] from currfdseg[r][k−r*Sf], using the linear phase shift $e^{i2\pi k(-gfour_samplesperstep)/M}$. Block 910 forms the uncompensated main-output spectrum by splicing together the second-pass match-output sections in currfdseg[][], using an overlap of WOVf samples between sections, and storing results into mappedframe. Splicing weights splicewx[m] and splicewy[m] are linear ramps with the property that splicewx[m]+splicewy[m]=1.0, for m=0 . . . WOVf−1.

An alternative method of defining second-pass reference sections is shown in the program listing for block 706. When this alternative is enabled, the processing operations of block 909 are disabled, and the contents of prevfdseg[][] are instead determined in block 706, after overlap addition. In the alternative method, a time-domain reference segment is obtained by windowing the partially constructed output time-domain signal, and subject to a forward transform operation. The subtask window_frame( . . . ) windows the time-domain output signal, pointed to by outbufptr, using a time-scaled analysis window, pointed to by gsynthesis_win. This segment is then rotated and processed by a 1024-point in-place FFT as described in the discussion of blocks 800 and 801. Second-pass reference sections are obtained by copying the resulting spectrum values into prevfdseg[r][], for r=0. . . rfinal. This set of predicted sections serves as an alternative to the predicted sections calculated by block 909.

What is claimed is:

1. A method of synthesizing an audio signal using main-output transform-domain signal representations, wherein a plurality of candidate input sections are defined based on a plurality of input transform-domain signal representations, and wherein a reference section is defined based on at least one previously formed match-output section, comprising:

obtaining a selection result by comparing each of said plurality of candidate input sections with said reference section using a matching process, forming a match-output section based on said selection result, forming main-output transform-domain signal representations based on at least one match-output section, and outputting an audio signal that is representative of said main-output transform-domain signal representations.

2. The method of claim 1 wherein said input transform-domain signal representations further comprise transformed time-domain acoustic signal representations.

3. The method of claim 2 wherein said input transform-domain signal representations further comprise transformed time-domain audio signal representations.

4. The method of claim 3 wherein said input transform-domain signal representations further comprise transformed time-domain speech signal representations.

5. The method of claim 1 wherein said method further includes a resampling step.

6. The method of claim 5 wherein said resampling step further results in the modification of a pitch frequency.

7. The method of claim 5 wherein said resampling step is further carried out in the transform domain.

8. The method of claim 1 wherein said input transform-domain signal representations are further obtained by transforming a time-domain input signal.

9. The method of claim 8 wherein said transforming further comprises windowing said time-domain input signal with a windowing function to obtain an input time-domain segment, and applying a block-transform operation to said input time-domain segment.

10. The method of claim 9 wherein said windowing function is a Hanning window.

11. The method of claim 9 wherein said block-transform operation further comprises an FFT algorithm.

12. The method of claim 9 wherein said windowing further comprises shifting said windowing function by an analysis shift which is determined on the basis of at least a time-domain matching process.

13. The method of claim 12 wherein said analysis shift is further determined on the basis of a signal modification parameter and a predefined synthesis shift.

14. The method of claim 1 further comprising inverse-transforming said main-output transform-domain signal representations to obtain inverse-transformed signal representations by applying a block-transform operation to said main-output transform-domain signal representations.

15. The method of claim 14 wherein said block-transform operation further comprises an FFT algorithm.

16. The method of claim 14 wherein said combining further comprises the step of overlap addition.

17. The method of claim 16 wherein said step of overlap addition further utilizes a predefined time-domain synthesis shift.

18. The method of claim 14 wherein said reference section is defined based on at least one match-output section from a previous synthesis block.

19. The method of claim 18 wherein said reference section is defined based on main-output transform-domain signal representations from a previous synthesis block.

20. The method of claim 19 wherein said reference section is defined using a procedure which further comprises windowing a time-domain output signal to obtain a time-domain reference segment, and transforming said time-domain reference segment using a forward block-transform operation.

21. The method of claim 18 wherein said reference section is a prediction of the match-output section to be formed based on said selection result.

22. The method of claim 21 wherein said prediction is defined using a linear phase shift in the transform domain.

23. The method of claim 1 wherein said steps of defining a plurality of candidate input sections, defining a reference section, obtaining a selection result, and forming a match-output section are further repeated for a plurality of match-output sections.

24. The method of claim 23 wherein said sections are further overlapping in an independent variable of said plurality of match-output sections.

25. The method of claim 24 wherein said independent variable is frequency.

26. The method of claim 25 wherein said match-output sections are formed in the order of low frequency to high frequency.

27. The method of claim 26 wherein multiple passes from low frequency to high frequency are cascaded.

28. The method of claim 25 wherein at least one match-output section has a predefined width in frequency.

29. The method of claim 25 wherein at least one match-output section has an output starting frequency index that differs from another output starting frequency index by a predefined frequency-domain synthesis shift.

30. The method of claim 24 wherein said reference section is defined based on an overlapping match-output section.

31. The method of claim 1 wherein second input transform-domain signal representations are formed by dividing a spectrum envelope out of first input transform-domain signal representations.

32. The method of claim 31 wherein said second input transform-domain signal representations are further complex-valued samples, and wherein said candidate input sections comprise magnitudes of said complex-valued samples.

33. The method of claim 31 wherein said spectrum envelope is further obtained using at least the methods of linear prediction.

34. The method of claim 33 wherein said spectrum envelope is further obtained using a truncated sequence of cepstral coefficients.

35. The method of claim 1 wherein second main-output transform-domain signal representations are formed by applying a spectrum envelope to first main-output transform-domain signal representations.

36. The method of claim 35 wherein said first main-output transform-domain signal representations are formed by splicing together match-output sections.

37. The method of claim 1 wherein said plurality of candidate input sections covers a range of frequency shifts.

38. The method of claim 1 wherein said plurality of candidate input sections covers a range of time shifts.

39. The method of claim 38 wherein said plurality of candidate input sections is defined using linear phase shifts.

40. The method of claim 1 wherein said plurality of candidate input sections covers a range of resampling factors.

41. The method of claim 1 wherein said matching process further comprises the computation of a cross-correlation.

42. The method of claim 41 wherein said cross-correlation is further normalized.

43. The method of claim 1 wherein said matching process further comprises the computation of a sum of squared differences.

44. The method of claim 43 wherein said sum of squared differences further comprises squares of differences between real components of complex values, and squares of differences between imaginary components of complex values.

45. The method of claim 1 wherein said matching process further comprises the computation of a sum of dot products.

46. The method of claim 1 wherein said match-output section is further formed based on a plurality of selection results, said plurality of selection results being obtained from a plurality of cascaded matching processes.

47. An apparatus for synthesizing an audio signal using main-output transform-domain signal representations, wherein a plurality of candidate input sections are defined based on a plurality of input transform-domain signal representations, and wherein a reference section is defined based on at least one previously formed match-output section, comprising:

first means for obtaining a selection result by comparing each of said plurality of candidate input sections with said reference section using a matching process, second means for forming a match-output section based on said selection result, third means for forming main-output transform-domain signal representations based on at least one match-output section, and fourth means for outputting an audio signal that is representative of said main-output transform-domain signal representations.

48. The apparatus of claim 47 further including means for obtaining said input transform-domain signal representations by transforming a time-domain input signal.

49. The apparatus of claim 48 wherein said apparatus is further connected to means for analog-to-digital conversion.

50. The apparatus of claim 49 further including means for receiving digital samples from said means for analog-to-digital conversion, and for storing said digital samples into an input circular memory.

51. The apparatus of claim 49 wherein said means for analog-to-digital conversion is further connected to means for transducing audible input.

52. The apparatus of claim 48 wherein said apparatus is further connected to means for digital-to-analog conversion.

53. The apparatus of claim 52 further including means for reading digital samples from an output circular memory, and for sending said digital samples to said means for digital-to-analog conversion.

54. The apparatus of claim 52 wherein said means for digital-to-analog conversion is further connected to means for producing audible output.

55. The apparatus of claim 48 wherein said first means, second means, third means, and fourth means operate to produce said output audio signal with a delay that is small enough to permit real-time interaction with an audience.

56. The apparatus of claim 55 used for purposes of live musical performance.

57. The apparatus of claim 56 used for purposes of Karaoke.

58. The apparatus of claim 55 used for purposes of making adjustments to a voice in a broadcast transmission such as radio or television.

59. The apparatus of claim 55 used for purposes of concealment of identity.

60. The apparatus of claim 59 used for purposes of disguising the voice of a protected witness in a courtroom proceeding or public interview.

61. The apparatus of claim 55 used for purposes of hearing aid.

* * * * *